US009303547B2

(12) United States Patent
Maier

(10) Patent No.: US 9,303,547 B2
(45) Date of Patent: Apr. 5, 2016

(54) INTERNAL COMBUSTION ENGINE WITH AT LEAST ONE CYLINDER

(71) Applicant: AVL LIST GMBH, Graz (AT)

(72) Inventor: Gerhard Maier, Wagersbach (AT)

(73) Assignee: AVL LIST GMBH, Graz (AT)

( * ) Notice: Subject to any disclaimer, the term of this patent is extended or adjusted under 35 U.S.C. 154(b) by 0 days.

(21) Appl. No.: 14/476,245

(22) Filed: Sep. 3, 2014

(65) Prior Publication Data

US 2015/0059666 A1 Mar. 5, 2015

(30) Foreign Application Priority Data

Sep. 4, 2013 (AT) ..... 50546/2013

(51) Int. Cl.

| | |
|---|---|
| ***F01P 1/04*** | (2006.01) |
| ***F01P 3/08*** | (2006.01) |
| ***F02F 3/22*** | (2006.01) |
| ***F01P 3/10*** | (2006.01) |
| *F02B 3/06* | (2006.01) |
| *F01M 1/08* | (2006.01) |

(52) U.S. Cl.

CPC ... *F01P 3/08* (2013.01); *F01P 3/10* (2013.01); *F02F 3/22* (2013.01); *F01M 1/08* (2013.01); *F02B 3/06* (2013.01); *F05C 2201/021* (2013.01)

(58) Field of Classification Search

CPC ..... F01P 3/08; F02F 3/22; F01M 1/08; F02B 3/06; F05C 2201/021

USPC ..... 123/41.35

See application file for complete search history.

(56) References Cited

U.S. PATENT DOCUMENTS 4,508,065 A * 4/1985 Suchdev ..... 123/41.35

FOREIGN PATENT DOCUMENTS

| | | | | |
|---|---|---|---|---|
| EP | 1070836 A2 | | 1/2001 | |
| FI | 20125167 A | | 8/2013 | |
| GB | 2498782 A | | 7/2013 | |
| KR | 20030016956 A | * | 3/2003 | ..... F02F 1/02 |

* cited by examiner

*Primary Examiner* — Lindsay Low
*Assistant Examiner* — Charles Brauch
(74) *Attorney, Agent, or Firm* — Jordan IP Law, LLC; Todd A. Vaughn

(57) ABSTRACT

An internal combustion engine that includes at least one cylinder with at least one piston reciprocating in a cylinder liner; a piston cooling device to cool the piston, and which includes at least one spraying tube with a spray nozzle which is directed towards a bottom side of the piston facing a crankcase, the at least one spraying tube being fixed to the cylinder liner; and a connecting channel arrangement to fluidically connect the spraying tube to an oil supply channel arranged in a cylinder block, the connecting channel arrangement including at least one connecting channel formed at least partly in the cylinder liner, and at least one curved connecting channel. In order to ensure reliable piston cooling, the connecting channel arrangement includes at least one curved connecting channel.

14 Claims, 2 Drawing Sheets

INTERNAL COMBUSTION ENGINE WITH AT LEAST ONE CYLINDER

CROSS-REFERENCE TO RELATED APPLICATIONS

The present application claims priority under 35 U.S.C. §119 to Austrian Patent Application No. A 50546/2013 (filed on (Sep. 4, 2013), which is hereby incorporated by reference in its entirety.

TECHNICAL FIELD

Embodiments relate to an internal combustion engine, comprising at least one cylinder with at least one piston reciprocating in a cylinder liner, a piston cooling device for cooling the piston, which cooling device comprises at least one spraying tube with a spray nozzle which is directed towards the bottom side of the piston facing the crankcase. The spraying tube is fixed to the cylinder liner, and is fluidically-connected via a connecting channel arrangement to an oil supply channel arranged in the cylinder block. The connecting channel arrangement comprises at least one connecting channel formed at least partly in the cylinder liner.

BACKGROUND

German Patent Publication No. DE 2 532 132 A1 discloses a spray nozzle for the cooling oil supply of pistons in reciprocating-piston internal combustion engines, which spray nozzle is fixed to a spray nozzle holder or is integrally arranged therewith, wherein the pistons comprise a cooling-oil feed borehole arranged in the axial direction.

U.S. Pat. No. 7,240,643 B1 discloses an internal combustion engine with a cylinder block and a cylinder liner in which a reciprocating piston is arranged. The bottom side of the piston is cooled via a spraying tube with a spray nozzle, wherein the spraying tube is fixed to the cylinder block and rests by way of a bracket on the cylinder liner.

A piston cooling device is known from WO 2013/121 105 A1, which comprises at least one spraying tube with a spray nozzle which is directed at the bottom side of the piston. The spraying tube is fixed to the cylinder liner and is supplied via a connecting channel arrangement. The connecting channel arrangement comprises a connecting channel formed into the cylinder liner.

EP 1 070 836 A2 discloses an apparatus for cooling the piston of an internal combustion engine, wherein cooling oil is sprayed against the bottom side of the piston by oil spray nozzles connected to feed channels. The feed channels are arranged in the cylinder.

A further cooling system for a motor block of an internal combustion engine is known from GB 2 498 782 A. The cooling system comprises a piston cooling device with spray nozzles which are connected to feed channels, wherein the feed channels are formed into the cylinder block.

Pistons of a highly loaded internal combustion engines are cooled by means of motor oil which is sprayed by a spray nozzles into the oil feed channel of the piston. The oil thus reaches the cooling chamber of the piston. The piston spray nozzles are fixed to a main oil channel or an oil supply channel of the piston cooling device depending on the motor size, which requires a relatively long guidance of the tube up to the position of the oil feed into the piston. These long tubes of the piston spray nozzles are mostly additionally supported, so that the retention rate in the oil feed channel is not reduced by vibrations or other imprecise items. Furthermore, the installation is highly restricted for the piston injection nozzles by the connecting rod and the counterweights of the crankshaft. It may thus easily occur during service work on the crankshaft, the connecting rod or the piston that the spray tubes of spray nozzles are bent. As a result, the cooling oil no longer reaches the oil feed channel of the piston, resulting in damage to the piston.

SUMMARY

In accordance with embodiments, an internal combustion engine is provided which avoids the aforementioned disadvantages and which ensures secure operation of the engine. In particular, damage to the piston cooling device during service work shall be prevented or at least reduced.

In accordance with embodiments, an internal combustion engine includes a connecting channel arrangement comprising at least one curved connecting channel. At least one straight connecting channel, which is preferably arranged in parallel to the cylinder axis, and at least one curved connecting channel, which is preferably arranged in an arc-shaped way, can be arranged in this case. It is preferably provided that the straight connecting channel is formed by at least one borehole arranged in the cylinder liner. It is further advantageous that a curved connecting channel is formed by at least one annular groove formed into the outer jacket surface of the cylinder liner. The annular groove can extend over the entire circumference of the outer jacket surface of the cylinder liner or only over a part of the circumference.

The straight connecting channel can be arranged downstream of the curved connecting channel and can originate therefrom. Preferably, at least one connecting channel, preferably the curved connecting channel, is in connection with the oil supply channel via a feed channel arranged in the cylinder block.

In accordance with embodiments, an especially sturdy configuration is provided in which the spraying tube is fixed to a face end of the cylinder liner which faces the crankcase and is preferably screwed onto said cylinder liner, and is connected to the connecting channel arrangement, preferably by way of the straight connecting channel.

In accordance with embodiments, advantageously the spraying tube may be formed having an L-shaped cross-section and is fixed to the cylinder liner via a fastening part. It can be provided in an alternative or additional way that the spraying tube is formed having a U-shaped cross-section and is inserted into the straight connecting channel, wherein the spraying tube is fixed via a fastening flange or a fastening claw to the cylinder liner.

In order to enable simple installation and disassembly it is advantageous if the fastening part and/or fastening claw (plus any fastening screws) are arranged within the diameter of a fitting surface of the cylinder liner. As a result, the cylinder liner plus the spraying tube that is attached thereto can be installed and disassembled in a short period of time, especially when the cooling device is arranged completely within the diameter of the fitting surface.

The fastening part and/or fastening claw as well as any fastening screws optionally provided for fixing are arranged outside of the cylinder diameter. This allows unobstructed emergence of the piston from the cylinder liner in the direction towards the crankcase.

It is further provided within the embodiments that the free length of the spraying tube is shorter than the diameter, preferably half the diameter, of the fitting surface of the cylinder liner. The cooling device is thus very rigid and protected from damage, so that misalignments of the spray nozzle can be avoided substantially, especially during service work.

In accordance with embodiments, an internal combustion engine comprises at least one of: at least one cylinder with at least one piston reciprocating in a cylinder liner; a piston cooling device to cool the piston, and which includes at least one spraying tube with a spray nozzle which is directed towards a bottom side of the piston facing a crankcase, the at least one spraying tube being fixed to the cylinder liner; and a connecting channel arrangement to fluidically connect the spraying tube to an oil supply channel arranged in a cylinder block, the connecting channel arrangement including at least one connecting channel formed at least partly in the cylinder liner, and at least one curved connecting channel.

DRAWINGS

Embodiments are described by way of example below with reference to the drawings.

DESCRIPTION

Figure 2:
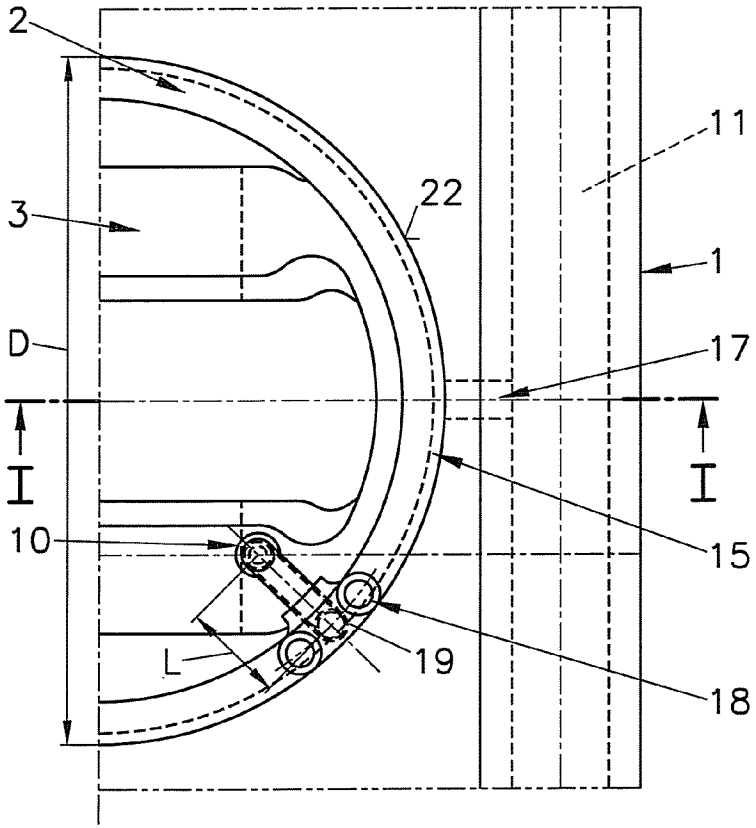
FIG. 2 illustrates the cylinder block of FIG. 1 in a bottom view.

Functionally identical parts are provided with the same reference numerals in the embodiments.

The drawings respectively show a cylinder block 1 of an internal combustion engine with at least one cylinder Z having a cylinder liner 2 with a cylinder axis 4, and in which a reciprocating piston 3 is arranged. A piston cooling device 5 is provided to cool the piston 3, and comprises a spraying tube 6 with a spray nozzle 7, which is directed towards an oil supply tube 10 in the region of the bottom side 9 of the piston which faces away from the combustion chamber 8 and faces the crankcase 16. The oil supply tube 10 opens into an annular cooling chamber 10*a* of the piston 3 in the region of the piston crown 3*a* of the piston 3 which faces the combustion chamber 8.

The spraying tube 6 is fluidically connected to an oil supply channel 11 formed in the cylinder block 1, which oil supply channel 11 is supplied by a main oil channel 12. The oil supply channel 11 may supply a plurality of cylinders Z. A pressure control valve 13 is provided spatially between the main oil channel 12 and the oil supply channel 11. This leads to an advantage in that only one pressure control valve 13 needs to be provided per oil supply channel 11 for the piston cooling device 5 for the cylinders Z. The pressure control valve 13 opens, for example, at approximately 1.5 bar, and thus, permits sufficient pressure build-up after starting within the internal combustion engine before oil cooling commences.

Figure 1:
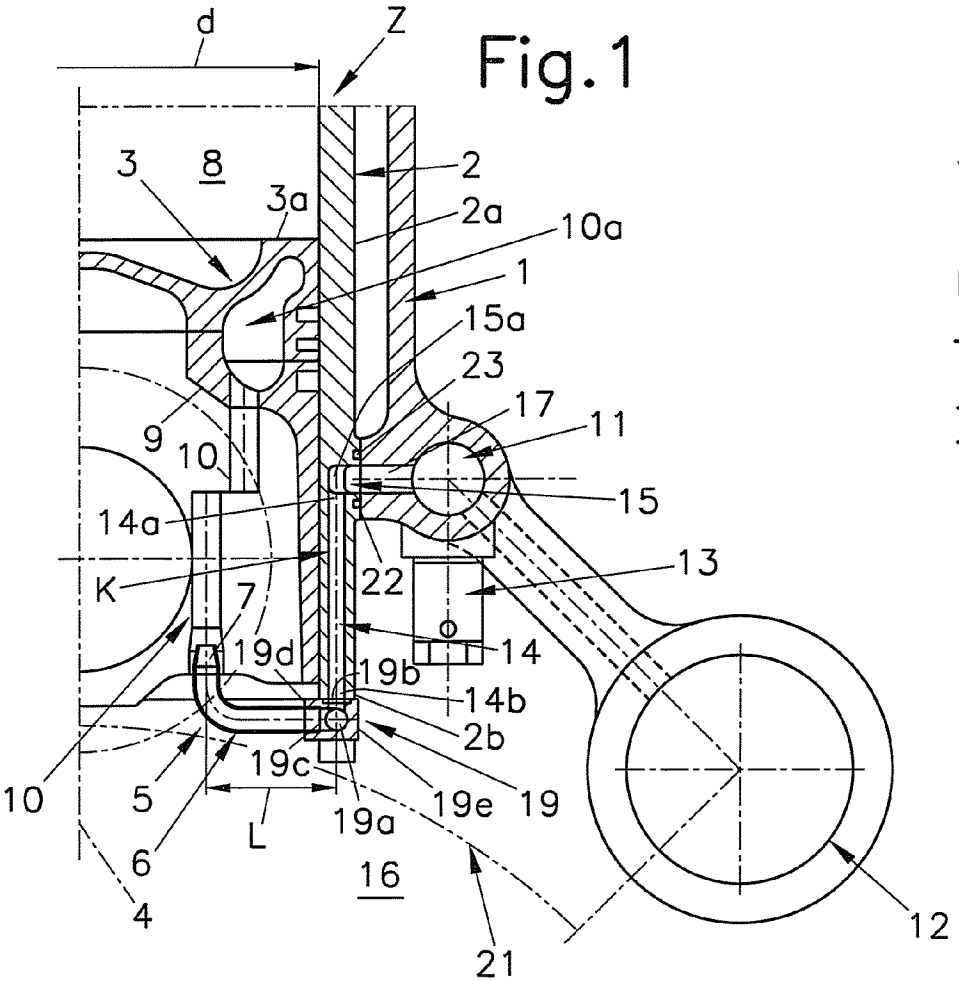
FIG. 1 illustrates a cylinder block of an internal combustion engine in accordance with embodiments in a sectional view along line I-I of FIG. 2, in which a straight connecting channel and a spraying tube are twisted in the plane of intersection.

The fluidic connection between the spraying tube 6 and the oil supply channel 11 occurs via a connecting channel arrangement K with connecting channels formed into the cylinder liners 2. The connecting channels include a first, straight connecting channel 14 which is arranged and extends parallel to the cylinder axis 4 and is formed by a high borehole in the cylinder liner 2, and a second, curved annexing channel 15 which is formed by an annular groove in the outer jacket surface 2*a* of the cylinder liner 2. The annular groove may be arranged over a part or over the entire circumference of the cylinder liner 2, such as, for example, by milling. As illustrated in FIG. 1, in the direction of the cylinder axis 4, sealing elements, such as, for example, O-rings 23 may be provided which extend spatially above and beneath the annular groove over the circumference of the cylinder liner 2, e.g., of known configuration. The sealing elements 23 may also be arranged in a different way and/or only extending over the circumference of the cylinder liner 2. Corresponding receptacles, e.g., in form of grooves, are formed in the outer jacket surface 2*a* of the cylinder liner 2 for mounting these sealing elements 23.

The straight connecting channel 14 originates in an initial region 14*a* from a groove side 15*a* of the curved connecting channel 15 facing the crankcase 16, and opens into the region of the face end 2*b* of the cylinder liner 2 facing the crankcase 16. The end region 14*b* of the straight connecting channel 14 faces the crankcase 16. The oil supply channel 11 is fluidically connected via a feed channel 17 arranged in the cylinder block 1 to the curved connecting channel 15. The end region 14*b* of the straight connecting channel 14 facing the crankcase 16 is fluidically connected to the spraying tube 6. The spraying tube 6 may be fixed, for example, to the face end 2*b* of the cylinder liner 2 facing the crankcase 16 mechanically by way of fastening screws 18.

A contour 21 of the counterweights of a crankshaft of the internal combustion engine is not illustrated in closer detail. Also provided is a cylindrical fitting surface 22 of the cylinder liner 2 in the cylinder block 1, whose diameter is designated with D.

In accordance with embodiments, the spraying tube 6 is directly fastened to the face end 2*b* of the cylinder liner 2 facing the crankcase 16, in which the oil supply occurs via the annular curved connecting channel 15 and the straight connecting channel 14 in the cylinder liner 2. In the case of highly loaded internal combustion engines from a bore of approximately 180 mm, the wall thicknesses of the cylinder liners 2 are already sufficiently large, so that the connecting channels 14, 15 can be arranged easily in the cylinder liner 2. This allows an especially short and rigid configuration of the spraying tube 6.

A highly flexible and independent positioning of the straight connecting channel 14 and therefore also the spraying tube 6 is enabled by arranging the curved metal channel 15 as an annular groove in the outer jacket surface 2*b* of the cylinder liner 2.

A further advantage of the connecting channel arrangement K integrated in the cylinder liner 2 is the possibility to pre-mount the spraying tube 6 plus the spray nozzle 7 on the cylinder liner 2 and to install them as a pre-mounted unit in the cylinder block 1, or conversely to remove the cylinder liner 2 plus the spray tubes 6 from the cylinder block 1 during maintenance or repair work. The free length L of the spraying tube 6 which is measured in the radial direction with respect to the cylinder liner 2 is shorter than half the diameter D of the fitting surface 22. This substantially prevents bending of the spraying tube 6, and further supports can be avoided.

As illustrated in FIGS. 1 and 2, the fixing of the spraying tube 6 is carried out by way of a fastening part 19 which is mechanically connected via the fastening screws 18 to the cylinder liner 2. The fastening part 19 is substantially arranged as a 90° deflection and comprises in its interior deflection channels 19*a* with an inlet opening 19*b* and an outlet opening 19*c*. The L-shaped spraying tube 6 is inserted (e.g., pressed) into the outlet opening 19*c*. The fastening part

19 is flange-mounted on the face end 2*b* of the cylinder liner 2, in which the inlet opening 19*b* is in alignment with the end region 14*b* of the straight connecting channel 14 which faces the crankcase 16. A face-end sealing element is provided for sealing between the fastening part 19 and the cylinder liner 2, which sealing element can be arranged, for example, as a sealing ring.

The embodiment illustrated in FIGS. 1 and 2 is especially suitable for internal combustion engines in which the piston 3 does not emerge from the cylinder liner 2 in the direction of the crankcase 16. The fastening part 19 can protrude with its inner side 19*b* with the outlet opening 19*c* facing the cylinder axis 4 slightly into the partial cylinder chamber facing the crankcase 16 and defined by the cylinder diameter d. The fastening part 19 should lie within the diameter D of the fitting surface 22 with its exterior side 19*e* facing away from the cylinder axis 4.

Figure 4:
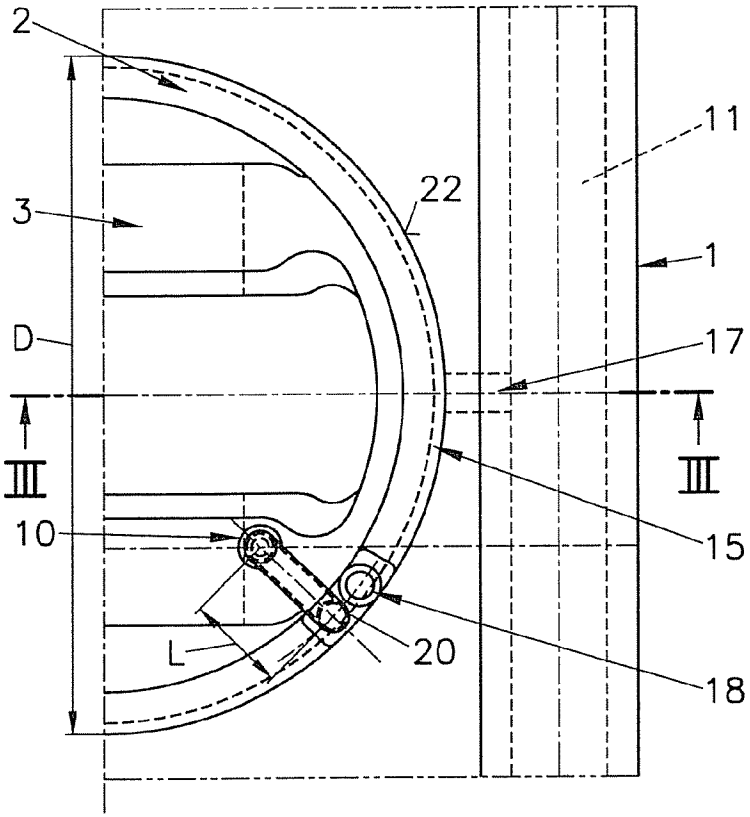
FIG. 4 illustrates the cylinder block of FIG. 3 in a bottom view.
Figure 3:
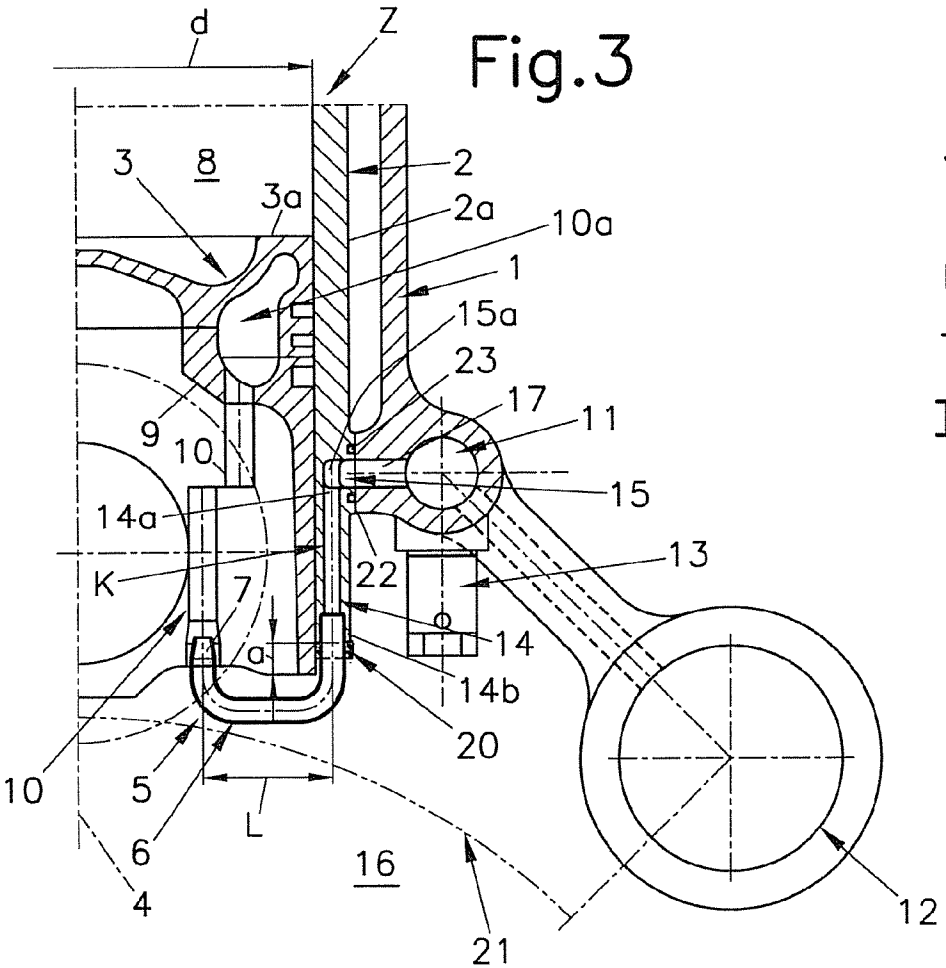
FIG. 3 illustrates a cylinder block in accordance with embodiments in a sectional view along line III-III of FIG. 4, in which a straight connecting channel and a spraying tube are twisted in the plane of intersection.

In the embodiment illustrated in FIGS. 3 and 4, the spraying tube 6 is arranged in a U-shaped manner. The spraying tube 6 is spatially positioned directly with its inlet end in the straight connecting channel 14 of the cylinder liner 2 and is fixed to the face end 2*b* of the cylinder liner 2 facing the crankcase 16 by way of a fastening bracket 20 and at least one fastening screw 18.

The embodiment illustrated in FIGS. 3 and 4 is especially suitable for internal combustion engines in which the piston 3 emerges from the cylinder liner 2 in the direction of the crankcase 16. The respective plunging path is designated with reference a.

The term "coupled" or "connected" may be used herein to refer to any type of relationship, direct or indirect, between the components in question, and may apply to electrical, mechanical, fluid, optical, electromagnetic, electromechanical or other connections. In addition, the terms "first," "second," etc. are used herein only to facilitate discussion, and carry no particular temporal or chronological significance unless otherwise indicated.

Those skilled in the art will appreciate from the foregoing description that the broad techniques of the embodiments can be implemented in a variety of forms. Therefore, while the embodiments have been described in connection with particular examples thereof, the true scope of the embodiments should not be so limited since other modifications will become apparent to the skilled practitioner upon a study of the drawings, specification, and following claims.

What is claimed is:

1. An internal combustion engine comprising: at least one cylinder with at least one piston reciprocating in a cylinder liner; a piston cooling device to cool the piston, and which includes at least one spraying tube with a spray nozzle which is directed towards a bottom side of the piston facing a crankcase, the at least one spraying tube being fixed to the cylinder liner; and a connecting channel arrangement to fluidically connect the spraying tube to an oil supply channel arranged in a cylinder block, the connecting channel arrangement including at least one connecting channel formed at least partly in the cylinder liner, at least one curved connecting channel, and at least one straight connecting channel, wherein:

the straight connecting channel is formed by at least one borehole arranged in the cylinder liner;

the spraying tube is fixed to a face end of the cylinder liner facing the crankcase and is connected to the connecting channel arrangement;

the spraying tube is fixed to the cylinder liner via a fastening part and/or a fastening claw; and the fastening part and/or the fastening claw are arranged within the diameter of a fitting surface of the cylinder liner, and outside of the cylinder diameter.

2. The internal combustion engine of claim 1, wherein the straight connecting channel is arranged parallel to a cylinder axis.

3. The internal combustion engine of claim 1, wherein the curved connecting channel is shaped in a form of a circular arc.

4. The internal combustion engine of claim 1, wherein the curved connecting channel is formed by at least one annular groove formed into an outer jacket surface of the cylinder liner.

5. The internal combustion engine of claim 1, wherein at least one straight connecting channel originates from the curved connecting channel or opens into said channel.

6. The internal combustion engine of claim 5, wherein the straight connecting channel is arranged downstream of at least one curved connecting channel.

7. The internal combustion engine of claim 1, wherein the curved connecting channel is connected to the oil supply channel via a feed channel formed in the cylinder block.

8. The internal combustion engine of claim 1, wherein the spraying tube is connected to the at least one straight connecting channel.

9. The internal combustion engine of claim 1, wherein the spraying tube has an L-shaped cross-section.

10. The internal combustion engine of claim 1, wherein the spraying tube has a U-shaped cross-section.

11. The internal combustion engine of claim 10, wherein the spraying tube is inserted into the at least one straight connecting channel.

12. The internal combustion engine of claim 1, wherein the cooling device is arranged completely within a diameter of the fitting surface.

13. The internal combustion engine of claim 1, wherein a length of the spraying tube is less than a diameter of the fitting surface of the cylinder liner.

14. The internal combustion engine of claim 13, wherein the length of the spraying tube is one-half the diameter of the fitting surface.

* * * * *